US012560166B2

(12) United States Patent
Takada et al.

(10) Patent No.: US 12,560,166 B2
(45) Date of Patent: Feb. 24, 2026

(54) PUMP ASSEMBLY WITH THE PUMP DISPOSED WITHIN THE PLURALITY OF TEETH OF THE MOTOR STATOR

(71) Applicants: Sumitomo Electric Sintered Alloy, Ltd., Takahashi (JP); Sumitomo Electric Industries, Ltd., Osaka (JP)

(72) Inventors: Shoichi Takada, Takahashi (JP); Kentaro Yoshida, Takahashi (JP); Tatsuya Saito, Osaka (JP); Tomoyuki Ueno, Osaka (JP)

(73) Assignees: Sumitomo Electric Sintered Alloy, Ltd., Takahashi (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 18/728,091

(22) PCT Filed: Aug. 17, 2023

(86) PCT No.: PCT/JP2023/029751

§ 371 (c)(1),
(2) Date: Jul. 11, 2024

(87) PCT Pub. No.: WO2024/134974

PCT Pub. Date: Jun. 27, 2024

(65) Prior Publication Data

US 2025/0101981 A1 Mar. 27, 2025

(30) Foreign Application Priority Data

Dec. 19, 2022 (JP) ..... 2022-202207

(51) Int. Cl.
*F04C 2/10* (2006.01)
*F04C 2/344* (2006.01)
(Continued)

(52) U.S. Cl.
CPC ..... *F04C 2/102* (2013.01); *F04C 2/344* (2013.01); *F04C 11/008* (2013.01); *F04C 15/00* (2013.01);
(Continued)

(58) Field of Classification Search
CPC .... F04C 2/102; F04C 15/0061; F04C 11/001; F04C 2240/40; F04C 2/344; F04C 11/008; F04C 15/00
See application file for complete search history.

(56) References Cited

U.S. PATENT DOCUMENTS 5,952,746 A * 9/1999 Mittmann ..... H02K 15/16 417/423.15
11,035,360 B2 * 6/2021 Wang ..... F04C 2/102
(Continued)

FOREIGN PATENT DOCUMENTS

JP H09-014157 A 1/1997
JP 2012-120249 A 6/2012
(Continued)

OTHER PUBLICATIONS

International Search Report and Written Opinion mailed on Nov. 7, 2023, received for PCT Application PCT/JP2023/029751, filed on Aug. 17, 2023, 9 pages including English Translation.

*Primary Examiner* — Mary A Davis
(74) *Attorney, Agent, or Firm* — XSENSUS LLP

(57) ABSTRACT

A pump assembly includes an axial gap motor including a first stator, a motor rotor and a motor shaft, and a first pump including a first pump rotor configured to be rotated by the motor rotor. The first stator includes a first yoke having an annular shape and a plurality of first teeth disposed on a first surface of the first yoke. The first pump is disposed in a first internal space surrounded by the plurality of first teeth.

10 Claims, 9 Drawing Sheets

(51) Int. Cl.
*F04C 11/00* (2006.01)
*F04C 15/00* (2006.01)

(52) U.S. Cl.
CPC ..... *F04C 15/0061* (2013.01); *F04C 11/001* (2013.01); *F04C 2240/40* (2013.01)

(56) References Cited

U.S. PATENT DOCUMENTS

2005/0265860 A1* 12/2005 Kameya ..... F04C 15/0061
417/410.3
2012/0164009 A1* 6/2012 Sakata ..... F04C 2/102
418/171

FOREIGN PATENT DOCUMENTS

JP 2014-173443 A 9/2014
JP 2020-182269 A 11/2020

* cited by examiner

PUMP ASSEMBLY WITH THE PUMP DISPOSED WITHIN THE PLURALITY OF TEETH OF THE MOTOR STATOR

CROSS-REFERENCE TO RELATED APPLICATIONS

The present application is based on PCT filing PCT/JP2023/029751, filed on Aug. 17, 2023, which claims priority from Japanese Patent Application No. 2022-202207, filed on Dec. 19, 2022, the entire contents of each are incorporated herein by reference.

TECHNICAL FIELD

The present disclosure relates to a pump assembly.

BACKGROUND ART

An axial gap motor has a stator, a motor rotor, and a motor shaft. In the axial gap motor, the magnetic flux from the stator to the rotor flows in parallel to the axis of the motor shaft. The axial gap motor has an advantage of a small length along the axis.

PTL 1 discloses a pump assembly combining an axial gap motor and an electric pump for pumping a fluid. In this pump assembly, the axial gap motor and the electric pump are arranged side by side in a direction along the axis of a motor shaft. Such a pump assembly is compact, taking advantage of the small axial gap motor size along the axis. In the pump assembly using a radial gap motor, the size of the motor shaft along the axis is large.

CITATION LIST

Patent Literature

PTL 1: Japanese Unexamined Patent Application Publication No. 2020-182269

SUMMARY OF INVENTION

A pump assembly of the present disclosure includes an axial gap motor including a first stator, a motor rotor and a motor shaft, and a first pump including a first pump rotor configured to be rotated by the motor rotor. The first stator includes a first yoke having an annular shape and a plurality of first teeth disposed on a first surface of the first yoke. The first pump is disposed in a first internal space surrounded by the plurality of first teeth.

DETAILED DESCRIPTION

Figure 1:
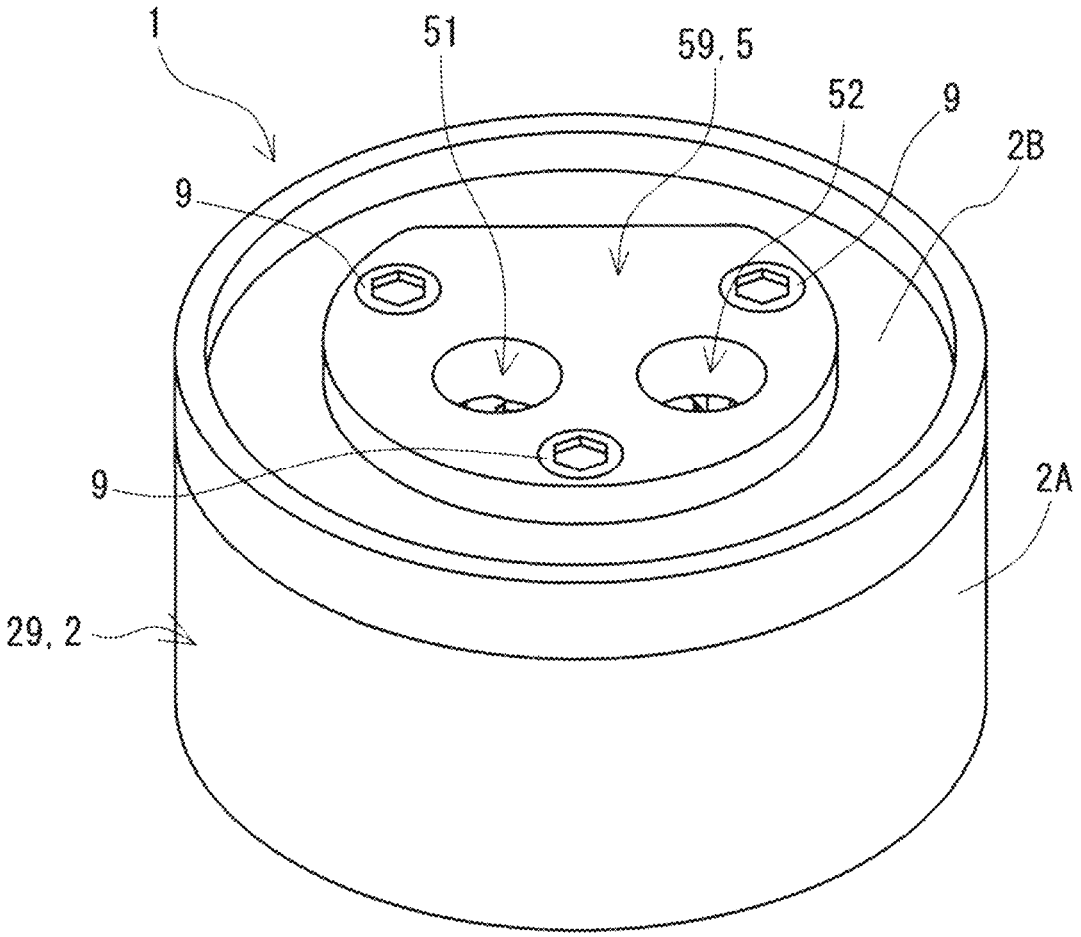
FIG. 1 is a schematic perspective view of a pump assembly according to the first embodiment.

Problems to be Solved by Present Disclosure

The pump assembly may be disposed in a narrow space such as a space in an automobile. Therefore, even when the axial gap motor is used, a pump assembly having a more compact length along the axis is required.

One object of the present disclosure is to provide a pump assembly that is more compact in size along the axis of the motor shaft than conventional pump assemblies.

Advantageous Effects of Present Disclosure

The pump assembly of the present disclosure is more compact than conventional pump assemblies.

Description of Embodiments of Present Disclosure

First, embodiments of the present disclosure will be listed and described.

<1> A pump assembly of the present disclosure includes an axial gap motor including a first stator, a motor rotor and a motor shaft, and a first pump including a first pump rotor configured to be rotated by the motor rotor. The first stator includes a first yoke having an annular shape and a plurality of first teeth disposed on a first surface of the first yoke. The first pump is disposed in a first internal space surrounded by the plurality of first teeth.

In the pump assembly described in the <1>, the first pump is disposed in the first internal space of the axial gap motor surrounded by the plurality of first teeth. Therefore, the length of the motor shaft along the axis in the pump assembly described in the <1> is smaller than the length of the motor shaft along the axis in the conventional pump assembly.

In the pump assembly described in the <1>, the first pump is disposed in the first internal space. That is, the first pump is disposed inside the axial gap motor and is surrounded by constituent members of the axial gap motor. Therefore, the operating noise of the first pump is unlikely to leak to the outside of the pump assembly. Therefore, the pump assembly described in the <1> is excellent in quietness.

In the pump assembly described in the <1>, the temperature of the first pump disposed in the first internal space of the axial gap motor is likely to rise due to the heat generation of the axial gap motor. When the temperature of the first pump rises, the temperature of the fluid in the first pump rises, and the viscosity of the fluid decreases. As a result, the load of the axial gap motor is reduced, and the power consumption of the axial gap motor is reduced. In particular, after the start of the axial gap motor in which the temperature of the fluid is low, the load of the axial gap motor is likely to be reduced at an early stage. The first pump disposed in the first internal space has a high heat capacity due to its structure. Therefore, the first pump easily receives heat generated by the axial gap motor, and can suppress heat generation of the axial gap motor. The fluid in the present disclosure may be a liquid, a gas, or a mixture of a gas and a liquid.

<2> In the pump assembly according to <1>, the first pump rotor may be coaxially fixed to the motor shaft.

In the pump assembly described in the <2>, the motor shaft of the motor rotor also serves as a drive shaft of the pump rotor. Therefore, the number of parts of the pump assembly is reduced, and the pump assembly is more compact. Further, since the first pump rotor rotates in complete synchronization with the rotation of the motor rotor, the number of rotations of the first pump rotor, that is, the flow rate of the fluid, can be easily controlled by the axial gap motor.

<3> In the pump assembly according to <1> or <2>, the first pump may have an inlet port and an outlet port. The inlet port and the outlet port may be arranged in a first direction as viewed from the first pump rotor. The first direction is a direction along an axis of the motor shaft and is a direction away from the motor rotor.

Since the motor rotor does not exist in the first direction as viewed from the first pump rotor, the inlet port and the outlet port can be easily arranged. Further, since the inlet port and the outlet port are arranged in the first direction, an increase in the diameter of a stator core is suppressed.

Unlike the configuration described in the <3>, when the inlet port and the outlet port are arranged in the radial direction, the inlet port and the outlet port are arranged in a gap between a plurality of first teeth arranged in the first yoke having an annular shape. The radial direction is a direction orthogonal to the axis of the motor shaft and is a direction away from the axis. The inlet port and the outlet port along the radial direction increase the interval between the plurality of first teeth, and thus the diameter of the stator core is likely to increase.

<4> In the pump assembly according to any one of <1> to <3>, the first pump may be an internal gear pump including an external gear and an internal gear. The external gear may be the first pump rotor.

The internal gear pump with the external gear disposed inside the internal gear is compact. The internal gear pump is easily disposed in the first internal space having a size restriction. Also, the internal gear pump is more space efficient than other pumps of the same size. Therefore, the pump assembly described in the <4> is compact and can easily increase the flow rate of the fluid.

<5> In the pump assembly according to <4>, the axial gap motor may include a motor housing configured to house the first stator and the motor rotor. The internal gear pump may include a pump housing configured to house the external gear and the internal gear. The motor housing includes a base portion to which the first yoke is fixed. The pump housing includes a body, a pump cover, and a bolt. The body includes a cylindrical portion, a bottom portion, and an annular flange portion, the cylindrical portion being configured to cover an outer periphery of the internal gear, the bottom portion being configured to seal a first end surface of the cylindrical portion, and the annular flange portion extending toward an outside of the cylindrical portion from an outer peripheral surface of the cylindrical portion at a position near a second end surface of the cylindrical portion. The pump cover is configured to seal an opening of the cylindrical portion at the second end surface. The bolt is configured to fix the pump cover to the annular flange portion. The annular flange portion constitutes the base portion.

In the configuration described in the <5>, the pump cover of the pump housing is fixed to the annular flange portion integrated with the body of the pump housing by the bolt. Therefore, it is not necessary to provide a bolt hole for disposing the bolt in the cylindrical portion covering the outer periphery of the internal gear. The cylindrical portion, which does not require a bolt hole, can be made thin. The outer diameter of the cylindrical portion can be reduced or the inner diameter of the cylindrical portion can be increased by the amount of the reduction in the thickness of the cylindrical portion. If the outer diameter of the cylindrical portion is reduced without changing the inner diameter of the cylindrical portion, the outer diameter of the pump assembly can be reduced without reducing the capacity of the internal gear pump. If the inner diameter of the cylindrical portion is increased without changing the outer diameter of the cylindrical portion, the capacity of the internal gear pump can be increased without increasing the outer diameter of the pump assembly.

<6> In the pump assembly according to any one of <1> to <3>, the first pump may be a vane pump. The first pump rotor may include a plurality of vanes.

The vane pump having the first pump rotor with a plurality of vanes is compact. The vane pump is easily disposed in the first internal space having a size restriction. Further, the vane pump has excellent sealing performance, and therefore, can easily pump even a gas, a liquid, or a mixture of a gas and a liquid.

<7> In the pump assembly according to any one of <1> to <6>, the pump assembly may further include a second pump including a second pump rotor configured to be rotated by the motor rotor. The axial gap motor may further include a second stator disposed such that the motor rotor is interposed between the first stator and the second stator. The second stator includes a second yoke having an annular shape and a plurality of second teeth disposed on a second surface of the second yoke. The second pump is disposed in a second internal space surrounded by the plurality of second teeth.

An axial gap motor in which one motor rotor is interposed between a first stator and a second stator generates high torque. Such an axial gap motor is called an axial gap motor of single-rotor and double-stator type. The pump assembly described in the <7> includes a first pump and a second pump which are independent from each other. Therefore, the pump assembly described in the <7> can pressure-feed, for example, fluids of two independent systems. Further, since the first pump and the second pump are respectively disposed in the first internal space and the second internal space in the axial gap motor, the pump assembly described in the <7> is compact.

Details of Embodiments of Present Disclosure

Hereinafter, specific examples of the pump assembly of the present disclosure will be described with reference to the drawings. In the drawings, the same reference numerals denote the same or corresponding parts. The size of the members shown in the drawings is expressed for the purpose of clarifying the description, and does not necessarily represent the actual size. The present invention is not limited to these examples, but is defined by the scope of the claims, and is intended to include all modifications within the meaning and scope equivalent to the scope of the claims.

First Embodiment

Figure 2:
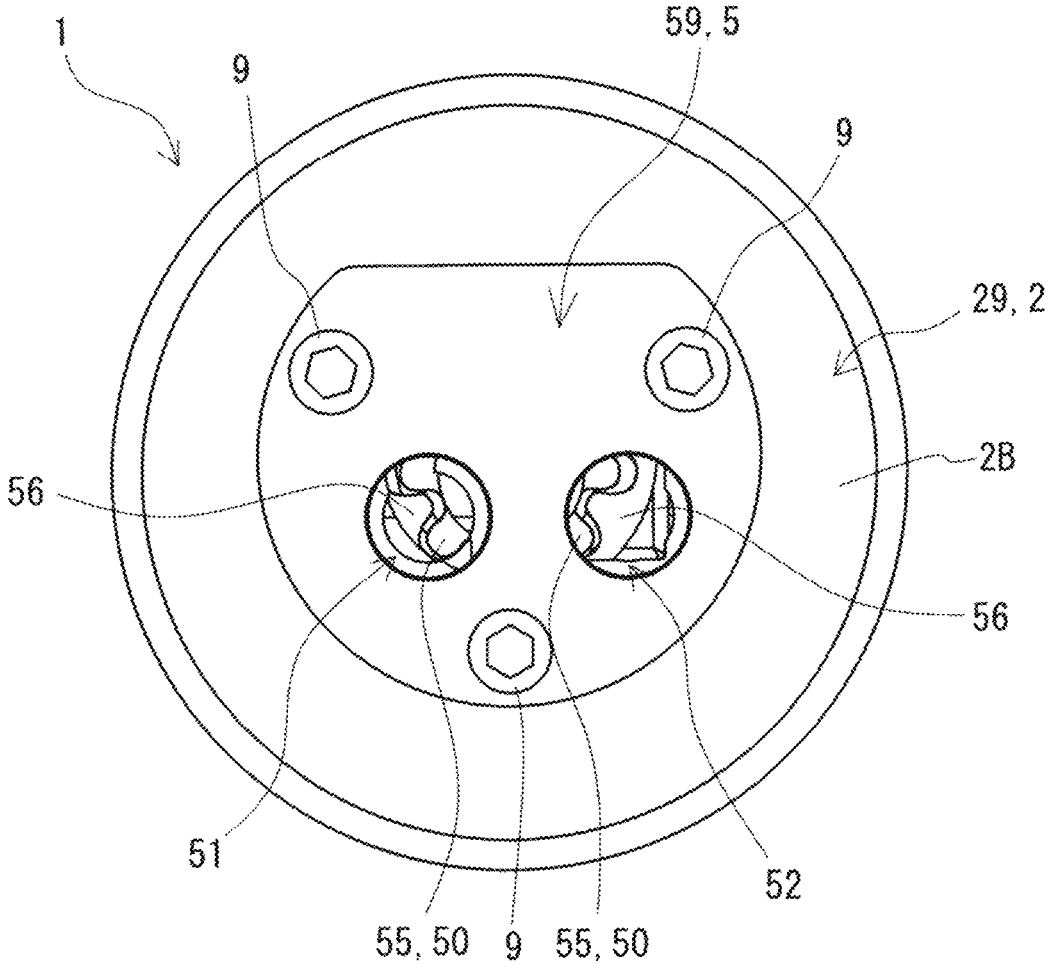
FIG. 2 is a schematic plan view of a pump assembly according to the first embodiment.

A pump assembly 1 shown in FIGS. 1 and 2 includes an axial gap motor 2 and a first pump 5. A motor housing 29 of axial gap motor 2 and a pump housing 59 of first pump 5 are visible from the outside of pump assembly 1. An inlet port 51 and an outlet port 52 are opened in pump housing 59. As shown in the plan view of FIG. 2, an external gear 55 and an internal gear 56 provided in first pump 5, which will be described later, are seen behind inlet port 51 and outlet port 52. Hereinafter, each configuration of pump assembly 1 will be described. In the following description, the "axial gap motor" is simply referred to as a "motor".

<<Motor>>

Figure 3:
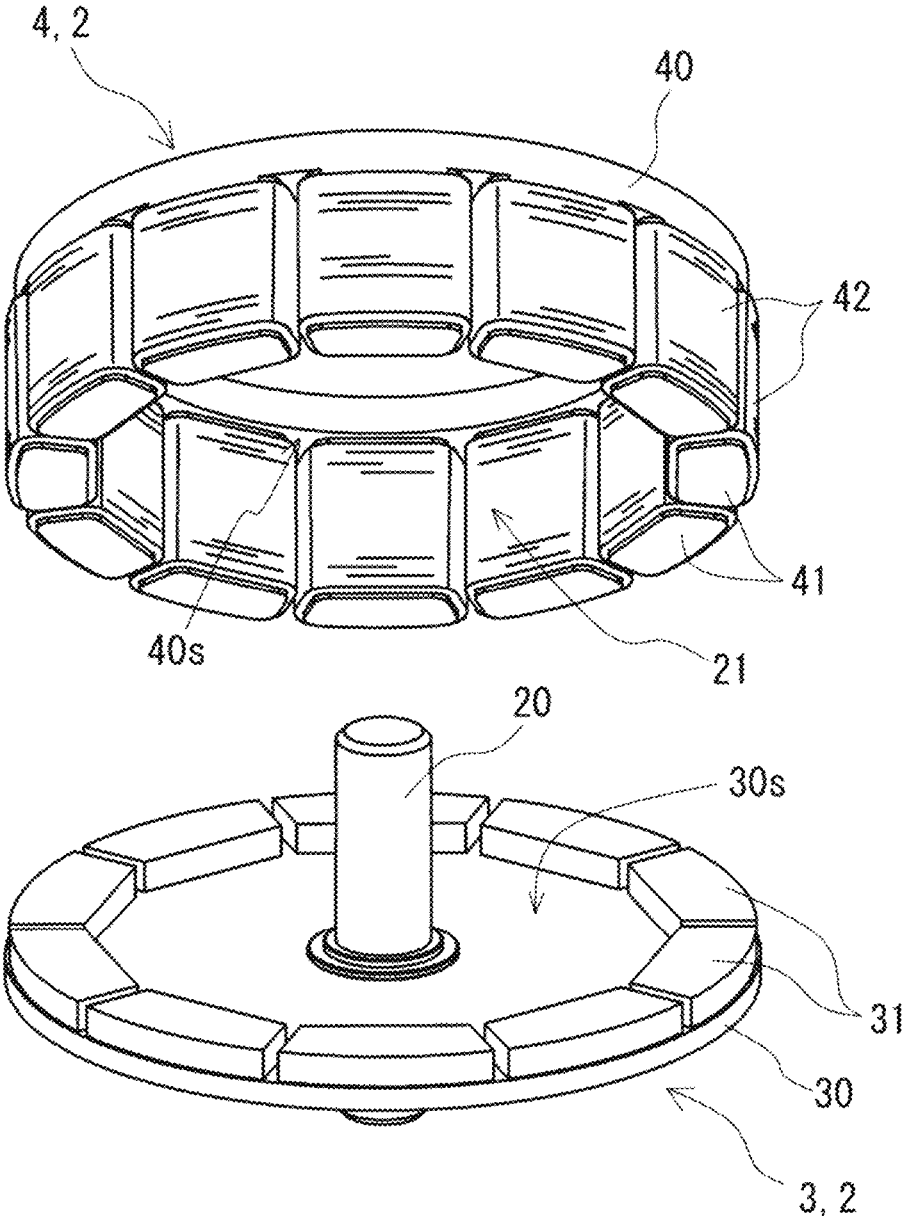
FIG. 3 is a schematic exploded perspective view of an axial gap motor provided in a pump assembly according to the first embodiment.
Figure 5:
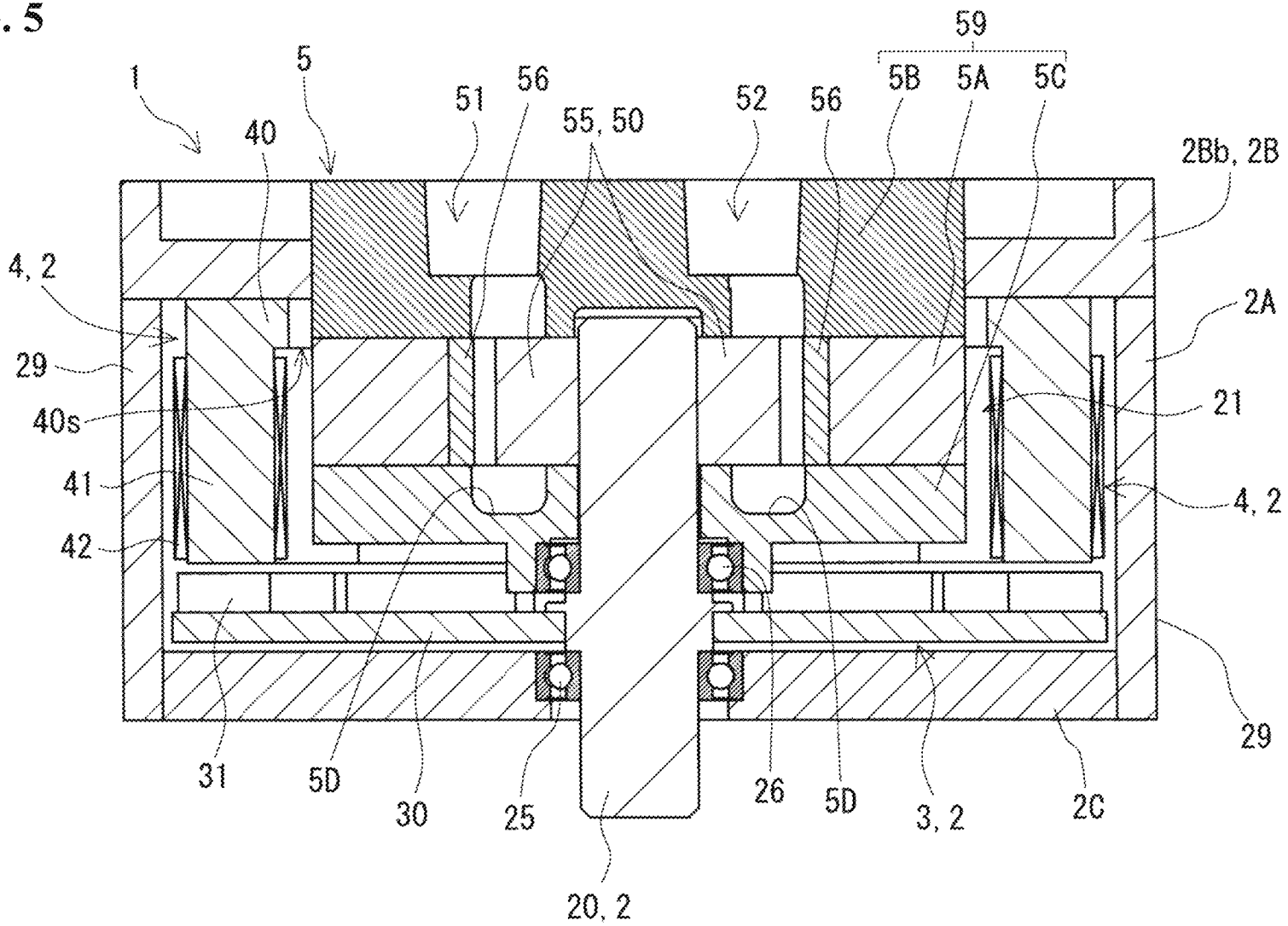
FIG. 5 is a cross-sectional view of the pump assembly of the first embodiment taken along the line V-V shown in FIG. 4.
Figure 6:
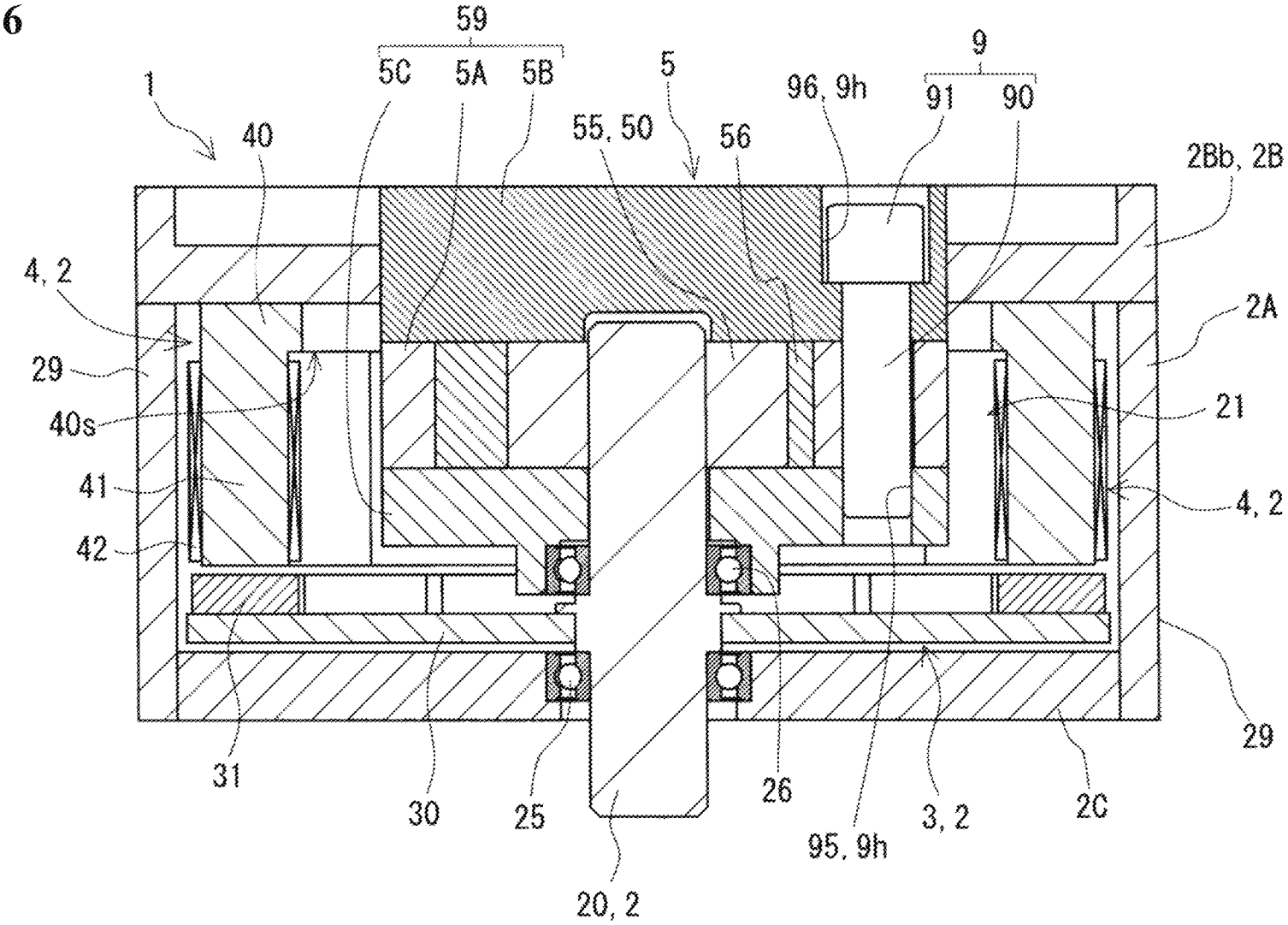
FIG. 6 is a cross-sectional view of the pump assembly of the first embodiment taken along the line VI-VI shown in FIG. 4.

In the description of motor 2, FIG. 3, which is an exploded perspective view of motor 2, is mainly referred to, and FIGS. 5 and 6, which are cross-sectional views of pump assembly 1, are referred to as necessary. Motor 2 includes a first stator 4, a motor rotor 3, and a motor shaft 20. As shown in FIGS. 5 and 6, first stator 4 and motor rotor 3 are disposed coaxially with motor shaft 20. First stator 4 and motor rotor 3 face each other with a gap therebetween in a direction along the axis of motor shaft 20. Motor 2 of the present embodiment is a motor of single-rotor and single-stator type including one first stator 4 and one motor rotor 3.

First stator 4 includes a first yoke 40, a plurality of first teeth 41, and a plurality of first coils 42. First yoke 40 is a plate member formed in an annular shape. First teeth 41 are columnar bodies. First teeth 41 protrude from a first surface 40*s* having a planar shape of first yoke 40. The plurality of first teeth 41 have the same shape and size. The shape of each first teeth 41 is, for example, a prismatic shape or a cylindrical shape. First stator 4 of the present embodiment is constituted by, for example, an integrated powder compact. As a modification of the present embodiment, first stator 4 may be constituted by a plurality of divided pieces.

The end surface of first teeth 41 faces a magnet 31 of motor rotor 3, which will be described later. First coil 42 is disposed on the outer peripheral surface of first teeth 41. When the current flows through first coil 42, first stator 4 is excited, and a rotating magnetic field is generated. In the present embodiment, the end portions of the winding constituting first coil 42 are not shown.

Motor rotor 3 includes a base plate 30 and a plurality of magnets 31. Base plate 30 is a plate member having a circular shape through which motor shaft 20 penetrates. Base plate 30 and motor shaft 20 are fixed to each other, and base plate 30 and motor shaft 20 rotate coaxially. Base plate 30 includes a base surface 30*s* facing first surface 40*s* of first yoke 40.

The plurality of magnets 31 are fixed to base surface 30*s* with an adhesive, for example. Magnet 31 is a permanent magnet. The plurality of magnets 31 are arranged at substantially equal intervals around the axis of motor shaft 20. Magnet 31 has, for example, a flat plate shape. The planar shape of magnet 31 is, for example, a shape corresponding to the shape of the end surface of first teeth 41. Magnet 31 is magnetized in a direction along the axis of motor shaft 20. The magnetization directions of two magnets 31 adjacent to each other around the axis of motor shaft 20 are opposite to each other. Magnet 31 is attracted to or repelled from first teeth 41 by the rotating magnetic field generated by first stator 4, whereby motor rotor 3 rotates with respect to first stator 4.

As shown in FIG. 5, motor 2 further includes motor housing 29. First stator 4 and motor rotor 3 are disposed inside motor housing 29. A part of motor shaft 20 is also disposed inside motor housing 29. As a modification of the present embodiment, entire motor shaft 20 may be disposed inside motor housing 29.

Motor housing 29 of the present embodiment constituted by a peripheral wall portion 2A, a first cover 2B, and a second cover 2C. Peripheral wall portion 2A is a cylindrical member. The inner diameter of peripheral wall portion 2A is larger than the outer diameter of first stator 4. The length of peripheral wall portion 2A along motor shaft 20 is greater than the length of first stator 4 along motor shaft 20.

First cover 2B is a member having a disc-shape that seals a first end portion of peripheral wall portion 2A. First cover 2B is a component independent of peripheral wall portion 2A. The first end portion is an end portion of first stator 4 adjacent to first yoke 40. First yoke 40 is fixed to first cover 2B. That is, first cover 2B functions as a base portion 2Bb to which first stator 4 is fixed. A part of first cover 2B of the present embodiment constitutes a first cover 5B of pump housing 59 described later. First cover 2B is provided with a flange at the edge of the outer periphery. The protruding height of pump housing 59 is the same as or lower than the end surface of the flange. Therefore, the protruding portion of pump housing 59 is housed in a recess space formed inside the flange of first cover 2B.

Second cover 2C is a member having a circular shape that seals a second end portion of peripheral wall portion 2A. The second end portion is an end portion opposite to the first end portion. Second cover 2C may be a component independent of peripheral wall portion 2A or may be a component integrated with peripheral wall portion 2A. In the present embodiment, peripheral wall portion 2A and second cover 2C are integrated by fitting second cover 2C prepared separately from peripheral wall portion 2A into peripheral wall portion 2A. Therefore, motor shaft 20 penetrates second cover 2C. A bearing 25 is disposed between second cover 2C and motor shaft 20, and motor shaft 20 is rotatably supported by second cover 2C. A seal member for suppressing leakage of fluid from motor housing 29 may be disposed at the position of bearing 25. As a modification of the present embodiment, when entire motor shaft 20 is disposed in motor housing 29, the inner surface of second cover 2C includes a recess into which the end portion of motor shaft 20 is fitted.

<<First Pump>>

Figure 4:
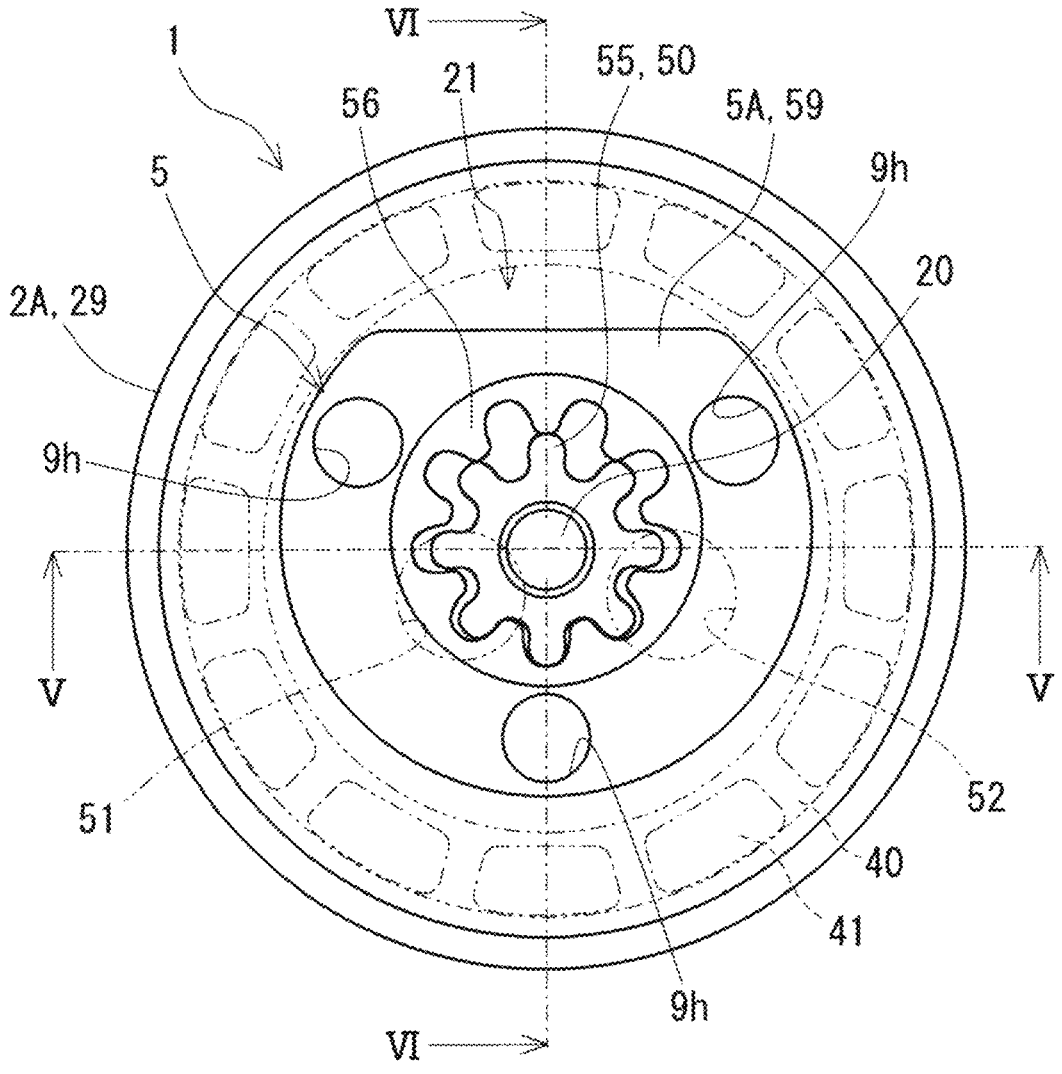
FIG. 4 is a schematic configuration view for explaining the arrangement state of a first pump in a pump assembly according to the first embodiment.

First pump 5 will be described mainly with reference to FIGS. 4 to 6. FIG. 4 is a view for explaining the arrangement state of first pump 5 in pump assembly 1, and some members of pump assembly 1 are omitted or simplified. For example, in FIG. 4, first cover 2B of motor housing 29 and motor rotor 3 are omitted. In FIG. 4, first cover 5B (FIGS. 5 and 6) of pump housing 59 described later is omitted, and a state where the inside of first pump 5 is exposed is shown. In FIG. 4, first stator 4, inlet port 51, and outlet port 52 are shown by two dot chain lines.

First pump 5 is for pumping the fluid. The fluid of the present embodiment is a liquid. For example, the fluid is machine oil. First pump 5 includes a first pump rotor 50 configured to be rotated by motor rotor 3. First pump 5 is disposed in a first internal space 21 surrounded by the plurality of first teeth 41.

First pump 5 of the present embodiment is an internal gear pump having external gear 55 and internal gear 56. External gear 55 is a disc-shaped gear having teeth on an outer periphery. The tooth profile of external gear 55 is formed by, for example, a trochoid curve. Internal gear 56 is a gear having a circular shape and teeth on the inner periphery. External gear 55 is disposed inside internal gear 56, and the teeth of external gear 55 and the teeth of internal gear 56 mesh with each other. In this internal gear pump, external gear 55 is first pump rotor 50.

External gear 55 and internal gear 56 are disposed inside pump housing 59. As shown in FIGS. 5 and 6, pump housing 59 of the present embodiment is constituted by a peripheral wall portion 5A, first cover 5B, and a second cover 5C. Peripheral wall portion 5A is a member having a tubular shape. As shown in FIG. 4, the outer periphery contour of peripheral wall portion 5A viewed from the direction along the axis of peripheral wall portion 5A has a shape like a circle partially cut in a straight line. A part of a bolt hole 9*h* described later is formed in peripheral wall portion 5A. The center of the circular arc of the outer periphery contour is shifted from the center of motor housing 29 to the upper side in FIG. 4, and coincides with the rotation center of internal gear 56 described later. Since peripheral wall portion 5A is cut, pump housing 59 can be disposed in first internal space 21 while ensuring the strength of pump housing 59. As a modification of the present embodiment, the center of the arc of the outer periphery contour of peripheral wall portion 5A may not coincide with the rotation center of internal gear 56. The center of the arc of the outer periphery contour of peripheral wall portion 5A may or may not coincide with the rotation center of external gear 55.

The inner peripheral contour line of peripheral wall portion 5A as viewed from the direction along the axis of peripheral wall portion 5A is circular. The inner diameter of peripheral wall portion 5A is slightly larger than the outer diameter of internal gear 56. Therefore, internal gear 56 can rotate while the outer peripheral surface of internal gear 56 is in contact with the inner peripheral surface of peripheral wall portion 5A. The rotation axis of internal gear 56 is stabilized by being supported by the inner peripheral surface of peripheral wall portion 5A.

As shown in FIG. 5, first cover 5B is a plate-shaped member that seals the first end portion of peripheral wall portion 5A. First cover 5B of the present embodiment is a component independent of peripheral wall portion 5A. As a modification of the present embodiment, first cover 5B may be a component integrated with peripheral wall portion 5A. First cover 5B may be a component integrated with first cover 2B of motor housing 29. In the present embodiment, first cover 5B is fitted into a through hole of annular base portion 2Bb constituting a part of first cover 2B of motor housing 29. That is, first cover 5B and base portion 2Bb into which first cover 5B is fitted constitute first cover 2B of motor housing 29. First cover 5B is formed with through holes constituting inlet port 51 and outlet port 52. A recess is formed on the inner surface of first cover 5B. An end portion of motor shaft 20 is rotatably fitted in the recess.

Second cover 5C is a plate-shaped member that seals the second end portion of peripheral wall portion 5A. Second cover 5C of the present embodiment is a component independent of peripheral wall portion 5A. As a modification of the present embodiment, second cover 5C may be a component integrated with peripheral wall portion 5A. The second end portion is an end portion opposite to the first end portion. A recess 5D is formed in a surface of second cover 5C facing first pump rotor 50. The number of recesses 5D in the present embodiment is two. Two recesses 5D are provided at positions facing each other across motor shaft 20. Each recess 5D has a substantially arc shape when viewed from the direction along the axis of motor shaft 20. Two recesses 5D may have different shapes or the same shape. Recess 5D reduces the sliding area between external gear 55 and second cover 5C and the sliding area between internal gear 56 and second cover 5C, thereby reducing the torque loss of first pump 5. Motor shaft 20 penetrates second cover 5C. A bearing 26 is disposed between motor shaft 20 and the through hole through which motor shaft 20 penetrates. Therefore, motor shaft 20 is rotably supported by second cover 5C. A seal member for suppressing leakage of the fluid from pump housing 59 may be disposed at the position of bearing 26.

As shown in FIG. 6, in the present embodiment, peripheral wall portion 5A, first cover 5B, and second cover 5C are integrated by a bolt 9. Bolt hole 9*h* in which bolt 9 is disposed extends from first cover 5B to second cover 5C through peripheral wall portion 5A. As shown in FIG. 4, the number of bolt holes 9*h* in the present embodiment is three. Three bolt holes 9*h* are arranged at equal intervals so as to surround internal gear 56.

As shown in FIG. 6, bolt 9 connects first cover 5B, peripheral wall portion 5A, and second cover 5C. First cover 5B of the present embodiment is integrated with first cover 2B of motor housing 29. Therefore, first cover 5B, peripheral wall portion 5A, and second cover 5C are connected by bolt 9, so that the first end portion of peripheral wall portion 2A of motor housing 29 is sealed by first cover 2B.

Bolt hole 9*h* of the present embodiment includes a smaller-diameter portion 95 in which a shaft 90 of bolt 9 is disposed and a larger-diameter portion 96 in which a head 91 of bolt 9 is disposed. A thread groove is formed in at least a portion of smaller-diameter portion 95 corresponding to second cover 5C. A screw groove may be formed in at least a part of a portion of smaller-diameter portion 95 corresponding to peripheral wall portion 5A. Head 91 is stopped by abutting against a step between smaller-diameter portion 95 and larger-diameter portion 96. Head 91 is housed in larger-diameter portion 96 and does not protrude from the end surface of first cover 5B. Therefore, head 91 does not increase the axial dimension of pump assembly 1. As shown in FIGS. 1 and 2, a tool hole into which a tool for rotating bolt 9 is fitted is formed in the end surface of head 91. The tool hole of the present embodiment has a hexagonal shape. The shape of the tool hole is not particularly limited.

As shown in FIG. 4, external gear 55 is coaxially fixed to motor shaft 20. That is, the rotation axis of external gear 55 and the rotation axis of motor shaft 20 coincide with each other. The rotation axis of external gear 55 also coincides with the axis of motor housing 29. External gear 55 rotates in perfect synchronization with the rotation of motor rotor 3. Therefore, the rotational speed of external gear 55 can be controlled by controlling the rotational speed of motor rotor 3. The flow rate of the fluid pumped by first pump 5 varies depending on the rotational speed of external gear 55.

The rotation axis of internal gear 56 positioned by peripheral wall portion 5A of pump housing 59 is shifted upward in the drawing from the rotation axis of external gear 55. Therefore, internal gear 56 rotates in accordance with the rotation of external gear 55, and the gap between external gear 55 and internal gear 56 moves in the rotation direction of motor shaft 20. Inlet port 51 and outlet port 52 are opened in a gap between external gear 55 and internal gear 56. Therefore, the fluid flowing into the gap from inlet port 51 is carried in the rotational direction of motor shaft 20 and is discharged to the outside of first pump 5 from outlet port 52.

Inlet port 51 and outlet port 52 are arranged at substantially symmetrical positions with motor shaft 20 interposed therebetween. Inlet port 51 and outlet port 52 are disposed in the first direction as viewed from first pump rotor 50, that is, external gear 55. The first direction is a direction along the axis of motor shaft 20 and is a direction away from motor rotor 3. In the present embodiment, inlet port 51 and outlet port 52 are formed in first cover 5B disposed in the first direction from first pump rotor 50. Inlet port 51 and outlet port 52 of the present embodiment extend in the first direction and open on the end surface of first cover 5B. As a modification of the present embodiment, inlet port 51 and outlet port 52 may be bent in an L shape, for example. In this case, inlet port 51 and outlet port 52 may be opened in a direction intersecting the first direction. Since rotating motor rotor 3 is not present at the positions where inlet port 51 and outlet port 52 are arranged, inlet port 51 and outlet port 52 can be easily arranged.

As a modification of the present embodiment, inlet port 51 and outlet port 52 may extend in the radial direction. The radial direction is a direction orthogonal to the axis of motor shaft 20 and is a direction away from the axis of motor shaft 20. In this case, inlet port 51 and outlet port 52 each extend from between two adjacent first teeth 41 to the outside of pump assembly 1.

In pump assembly 1 of the present embodiment, first pump 5 is disposed in first internal space 21 of motor 2. That is, the length of pump assembly 1 of the present embodiment along motor shaft 20 does not increase even though first pump 5 is provided. Such compact pump assembly 1 is easy to arrange in a narrow space such as the interior of an automobile.

First pump 5 generates an operating noise. The operating noise is, for example, a contact noise between external gear 55 and internal gear 56, and a pulsation noise generated when the fluid is pressure-fed. External gear 55 and internal gear 56, which are sources of operating noise, are surrounded by pump housing 59. Moreover, first pump 5 is disposed inside motor 2. Therefore, in pump assembly 1 of the present embodiment, the operating noise of first pump 5 is unlikely to leak to the outside of pump assembly 1. Pump assembly 1 of the present embodiment is excellent in quietness.

Motor 2 generates heat during operation. The temperature of first pump 5 disposed in first internal space 21 of motor 2 is likely to rise due to the heat generation of motor 2. When the temperature of first pump 5 rises, the temperature of the fluid in first pump 5 rises, and the viscosity of the fluid decreases. As a result, the load of motor 2 is reduced, and the power consumption of motor 2 is reduced. In particular, after starting motor 2, where the temperature of the fluid is low, the load of motor 2 can easily be reduced early. First pump 5 disposed in first internal space 21 has a high heat capacity due to its structure. Therefore, first pump 5 easily receives heat generated by motor 2, and can suppress heat generation of motor 2.

Second Embodiment

Figure 7:
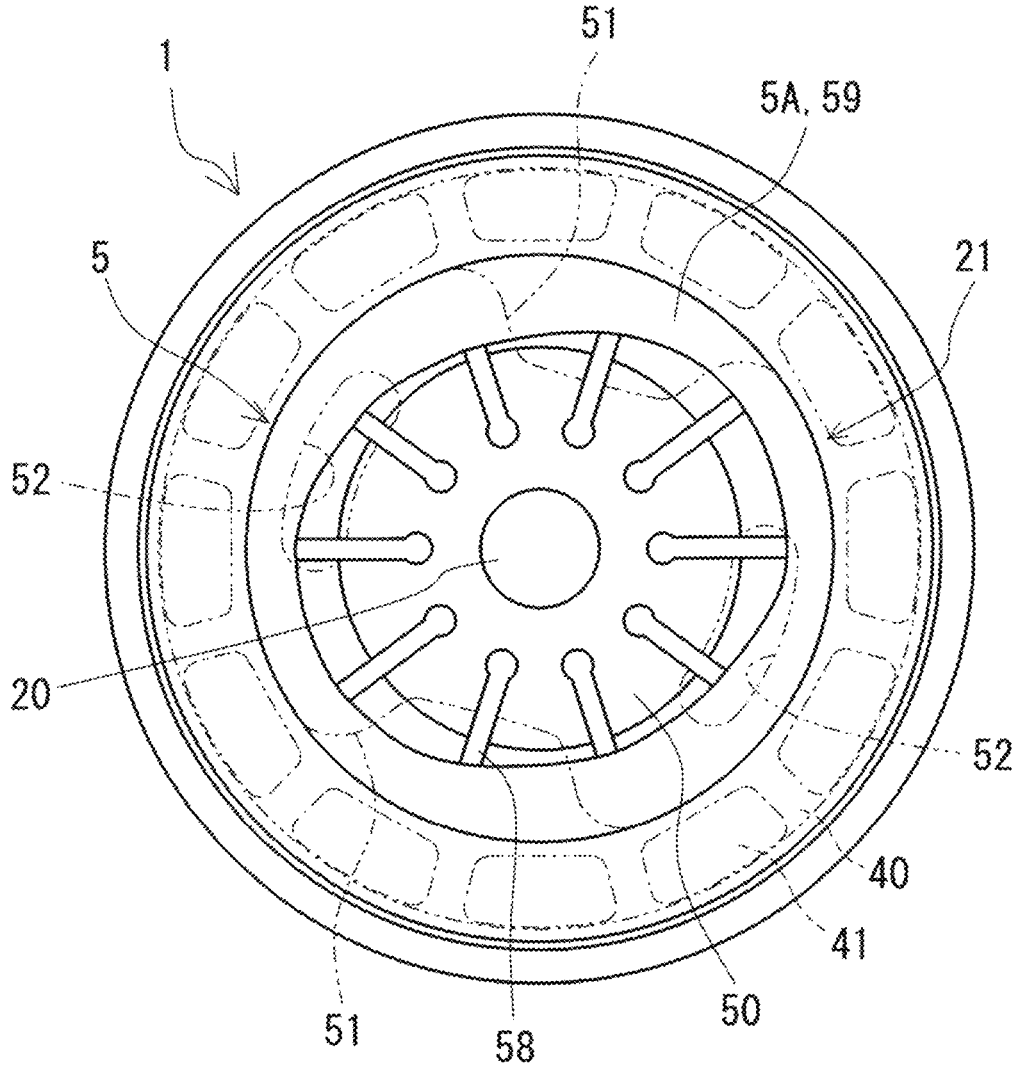
FIG. 7 is a schematic configuration view for explaining an arrangement state of a first pump in a pump assembly according to the second embodiment.

First pump 5 provided in pump assembly 1 is not limited to an internal gear pump. For example, first pump 5 may be an external gear pump, an impeller pump, a diaphragm pump, a vane pump, or a piston pump. In the second embodiment, pump assembly 1 including a vane pump as first pump 5 will be described with reference to FIG. 7. The view of FIG. 7 is the same as that of FIG. 4.

The vane pump includes first pump rotor 50 having a plurality of vanes 58. Vane 58 is configured to be movable forward and backward by, for example, a magnetic force or a centrifugal force. As viewed from the direction along the axis of motor shaft 20, the shape of the inner circumferential surface of pump housing 59 in which first pump rotor 50 is housed is substantially elliptical. As a modification of the present embodiment, the shape of the inner peripheral surface of pump housing 59 may be circular. As first pump rotor 50 rotates, the end portion of vane 58 comes into contact with the inner circumferential surface of pump housing 59, and vane 58 moves forward or backward. The fluid is arranged in the space surrounded by two adjacent vanes 58, 58, the inner circumferential surface of pump housing 59, and first pump rotor 50, and the fluid is carried in the rotation direction of first pump rotor 50 as first pump rotor 50 rotates. The vane pump has excellent sealing performance, and therefore can easily pump a gas, a liquid, or a mixture of a gas and a liquid.

Pump assembly 1 of the present embodiment includes two inlet ports 51 and two outlet ports 52. Inlet ports 51 and outlet ports 52 are alternately arranged around the axis of motor shaft 20. There may be one inlet port 51 and one outlet port 52.

Third Embodiment

Figure 8:
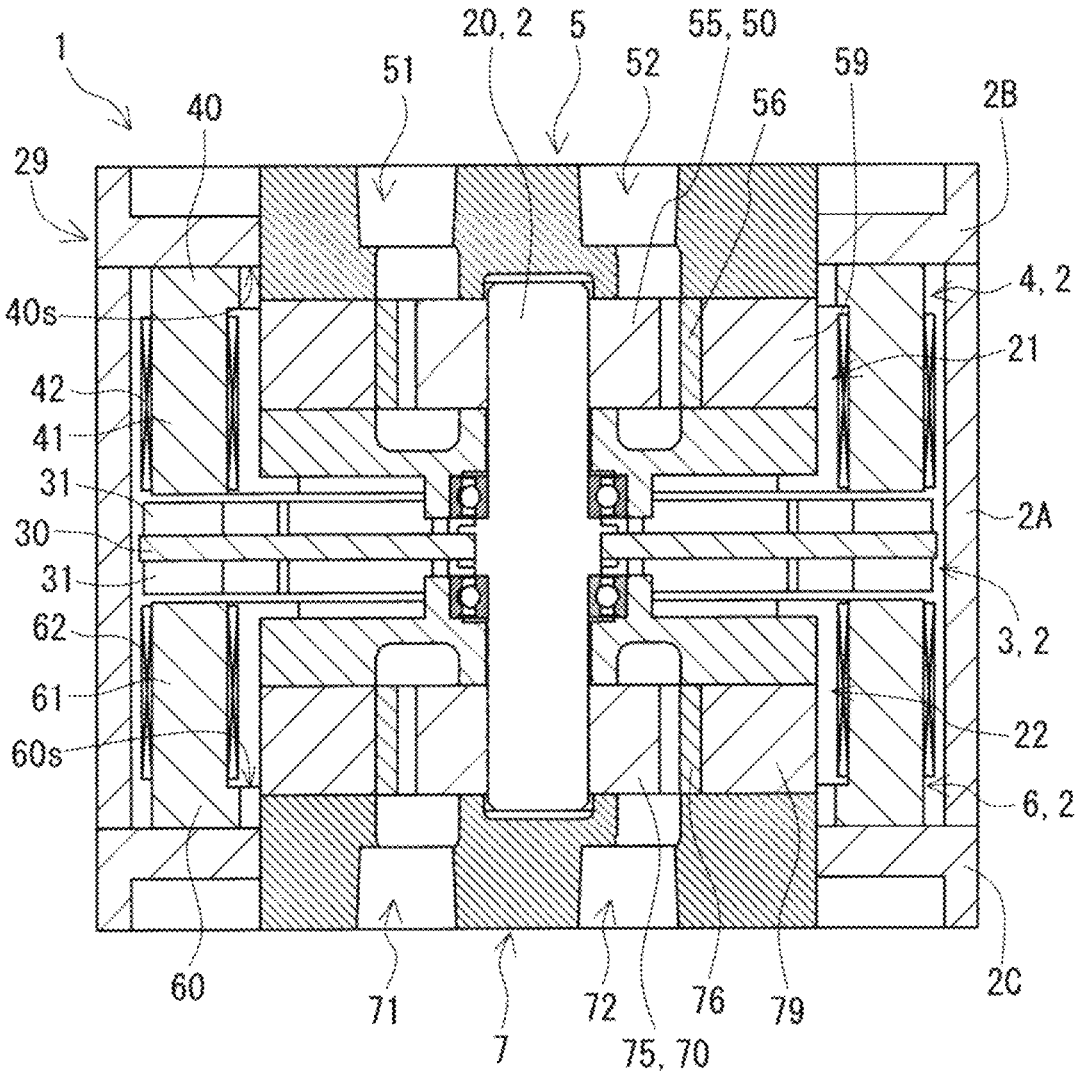
FIG. 8 is a schematic cross-sectional view of a pump assembly according to the third embodiment.

In the third embodiment, pump assembly 1 including motor 2 of single-rotor and double-stator type will be described with reference to FIG. 8. The view of FIG. 8 is similar to that of FIG. 5.

Motor 2 of the present embodiment further includes a second stator 6 that sandwiches motor rotor 3 between first stator 4 and second stator 6. Second stator 6 has the same configuration as first stator 4. That is, second stator 6 includes a second yoke 60 having an annular shape, a plurality of second teeth 61, and a plurality of second coils 62. Second teeth 61 are disposed on a second surface 60*s* of second yoke 60. Second surface 60*s* is a surface facing first surface 40*s* of first yoke 40. The end surface of second teeth 61 has the same shape as the end surface of first teeth 41 and faces the end surface of first teeth 41. That is, first stator 4 and second stator 6 are disposed symmetrically with respect to motor rotor 3.

Motor rotor 3 of the present embodiment also has the plurality of magnets 31 on the surface facing second stator 6. As a modification of the present embodiment, magnet 31 may be embedded in base plate 30. In this case, one magnet 31 corresponds to both first stator 4 and second stator 6.

Motor 2 of single-rotor and double-stator type is usually more space efficient than motor 2 of single-rotor and single-stator type.

Motor 2 has a second internal space 22 surrounded by a plurality of second teeth 61. A second pump 7 is disposed in second internal space 22. That is, first pump 5 and second pump 7 are disposed symmetrically with respect to motor rotor 3. Second pump 7 is a pump independent of first pump 5. Second pump 7 has the same configuration as first pump 5. That is, second pump 7 is an internal gear pump having an external gear 75 and an internal gear 76. External gear 75 is a second pump rotor 70 configured to be rotated by motor rotor 3. Specifically, second pump rotor 70 is coaxially fixed to motor shaft 20. That is, motor shaft 20 serves as a rotation axis of first pump rotor 50 and second pump rotor 70. External gear 75 and internal gear 76 are disposed inside a pump housing 79. As a modification of the present embodiment, first pump 5 and second pump 7 may be pumps of types other than the internal gear pump. First pump 5 and second pump 7 may be pumps of different types. For example, first pump 5 may be an internal gear pump, and second pump 7 may be a vane pump.

An inlet port 71 and an outlet port 72 extend along the axis of motor shaft 20. The opening of inlet port 71 and the opening of outlet port 72 are disposed at positions away from motor rotor 3. Since rotating motor rotor 3 is not present at the positions where inlet port 71 and outlet port 72 are arranged, inlet port 71 and outlet port 72 can be easily arranged.

Peripheral wall portion 2A of motor housing 29 has a size capable of housing both first pump 5 and second pump 7. Therefore, pump assembly 1 of the present embodiment is compact despite having two pumps.

First cover 2B of motor housing 29 of the present embodiment has the same configuration as first cover 2B of the first embodiment. Second cover 2C of motor housing 29 of the present embodiment has the same configuration as first cover 2B. Therefore, although a part of pump housing 79 penetrates second cover 2C, pump housing 79 does not protrude from the end surface of second cover 2C. As a modification of the present embodiment, pump housing 59 may protrude from the end surface of first cover 2B, and pump housing 79 may protrude from the end surface of second cover 2C.

Pump assembly 1 of the present embodiment having the configuration described above can pressure-feed fluids of two independent systems.

Fourth Embodiment

In the fourth embodiment, pump assembly 1 in which the configurations of motor housing 29 and pump housing 59 are different from those in the first embodiment will be described with reference to FIG. 9. In the present embodiment, the configuration other than motor housing 29 and pump housing 59 is the same as that of the first embodiment.

Figure 9:
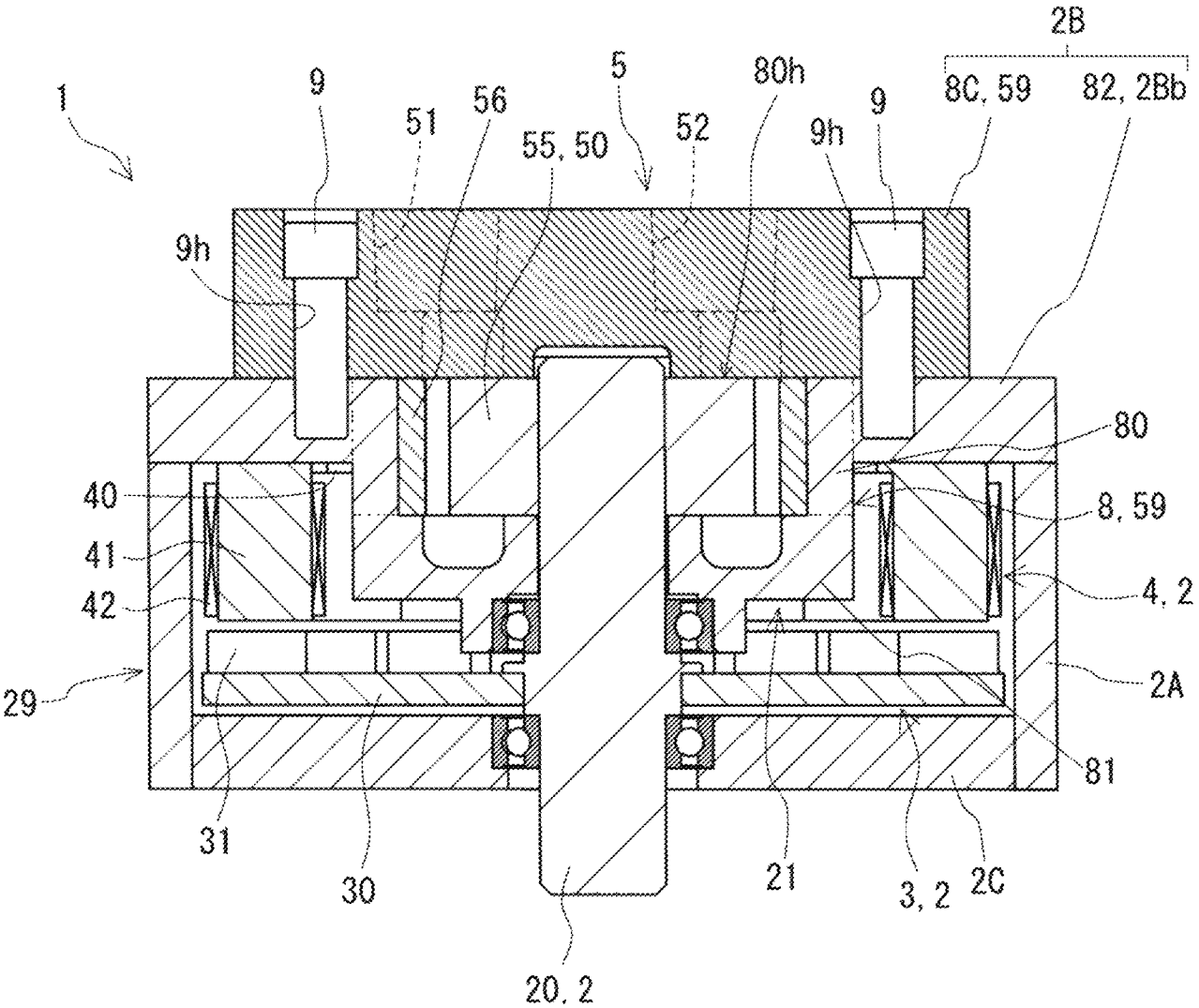
FIG. 9 is a schematic cross-sectional view of a pump assembly according to the fourth embodiment.

FIG. 9 is a cross-sectional view of pump assembly 1 of the present embodiment taken along a line corresponding to the line VI-VI in FIG. 4. The position of bolt 9 in the present embodiment is different from that in the first embodiment.

Pump housing 59 of the present embodiment includes a body 8 and a pump cover 8C. Body 8 is a bottomed cylindrical component including a cylindrical portion 80, a bottom portion 81, and an annular flange portion 82. In FIG. 9, the boundary between cylindrical portion 80 and bottom portion 81 and the boundary between cylindrical portion 80 and annular flange portion 82 are indicated by two dot chain lines.

Cylindrical portion 80 is a portion that covers the outer periphery of internal gear 56. That is, cylindrical portion 80 corresponds to peripheral wall portion 5A of pump housing 59 in the first embodiment. Bottom portion 81 is an arranged portion that seals the first end surface of cylindrical portion 80 and faces motor rotor 3. A through hole through which motor shaft 20 penetrates is formed in bottom portion 81. That is, bottom portion 81 corresponds to second cover 5C of pump housing 59 in the first embodiment. Annular flange portion 82 is a portion extending toward the outside of cylindrical portion 80 from the outer peripheral surface of cylindrical portion 80 at a position near the second end surface. The second end surface is an end surface opposite to the first end surface. The outside of cylindrical portion 80 is a direction away from the central axis of cylindrical portion 80. Annular flange portion 82 is generally annular in shape. First yoke 40 of first stator 4 is fixed to the surface of annular flange portion 82 facing motor rotor 3. That is, annular flange portion 82 corresponds to base portion 2Bb of motor housing 29 in the first embodiment. Body 8 in which cylindrical portion 80, bottom portion 81, and annular flange portion 82 are integrated is expected to contribute to a reduction in the number of assembly steps of pump assembly 1 and a reduction in the cost of pump assembly 1 due to a reduction in the number of components.

Pump cover 8C seals an opening 80*h* that opens to the second end surface of cylindrical portion 80. Pump cover 8C corresponds to first cover 5B of pump housing 59 in the first embodiment. The outer diameter of pump cover 8C is larger than the inner diameter of opening 80*h*. Pump cover 8C and annular flange portion 82 correspond to first cover 2B of motor housing 29 in the first embodiment.

Pump cover 8C is fixed to annular flange portion 82 of body 8 by bolt 9. Bolt hole 9*h* in which bolt 9 is disposed penetrates pump cover 8C and reaches annular flange portion 82. That is, when viewed in a direction along shaft 90 of bolt 9, shaft 90 does not overlap cylindrical portion 80 of body 8, and bolt hole 9*h* for disposing bolt 9 is not formed in cylindrical portion 80. Cylindrical portion 80 is thinner than peripheral wall portion 5A in the first embodiment by the amount of bolt hole 9*h* not formed. The outer diameter of cylindrical portion 80 can be reduced as compared with the configuration of the first embodiment by the amount of the reduction in the thickness of cylindrical portion 80. In the configuration of the first embodiment, if the outer diameter of cylindrical portion 80 is reduced without changing the inner diameter of cylindrical portion 80, the outer diameter of pump assembly 1 can be reduced without reducing the capacity of first pump 5. The outer diameter of pump assembly 1 is a dimension of pump assembly 1 in a direction orthogonal to the axis of motor shaft 20.

The inner diameter of cylindrical portion 80 may be reduced as compared with the configuration of the first embodiment by the amount of the reduction in the thickness of cylindrical portion 80. For example, in the configuration of the first embodiment, if the inner diameter of cylindrical portion 80 is increased without changing the outer diameter of cylindrical portion 80, the capacity of first pump 5 can be increased without increasing the outer diameter of the pump assembly. In addition, the outer diameter of cylindrical portion 80 may be reduced and the inner diameter of cylindrical portion 80 may be increased with respect to the configuration of the first embodiment.

In the configuration of the present embodiment in which bolt 9 is connected to annular flange portion 82, bolt 9 does not interfere with inlet port 51 and outlet port 52 in the first place. Therefore, the number and the position of bolts 9 in the present embodiment are less restricted than those in the configuration of the first embodiment.

The configurations of motor housing 29 and pump housing 59 shown in the fourth embodiment can also be applied to pump assembly 1 including motor 2 of single-rotor and double-stator type shown in the third embodiment.

REFERENCE SIGNS LIST

1 pump assembly
2 axial gap motor, motor
20 motor shaft, 21 first internal space, 22 second internal space
25, 26 bearing
29 motor housing
2A peripheral wall portion, 2B first cover, 2C second cover
2Bb base portion
3 motor rotor
30 base plate, 30*s* base surface
31 magnet
4 first stator
40 first yoke, 40*s* first surface
41 first teeth, 42 first coil
5 first pump

50 first pump rotor
51 inlet port, 52 outlet port
55 external gear, 56 internal gear
58 vane
59 pump housing
5A peripheral wall portion, 5B first cover, 5C second cover, 5D recess
6 second stator
60 second yoke, 60*s* second surface
61 second teeth, 62 second coil
7 second pump
70 second pump rotor
71 inlet port, 72 outlet port
75 external gear, 76 internal gear
79 pump housing
8 body
80 cylindrical portion, 81 bottom portion, 82 annular flange portion, 80*h* opening
8C pump cover
9 bolt
9*h* bolt hole
90 shaft, 91 head, 95 smaller-diameter portion, 96 larger-diameter portion

The invention claimed is:

1. A pump assembly comprising:
an axial gap motor including a first stator, a motor rotor and a motor shaft, the motor rotor including a plurality of magnets; and
a first pump including a first pump rotor configured to be rotated by the motor rotor,
wherein the first stator includes a first yoke having an annular shape and a plurality of first teeth disposed on a first surface of the first yoke,
the plurality of first teeth of the first stator face the plurality of magnets in an axial direction,
the first pump is disposed in a first internal space surrounded by the plurality of first teeth,
the axial gap motor further includes a motor housing,
a part of the motor shaft extends beyond the motor housing,
the motor housing includes:
a peripheral wall portion;
a first cover; and
a second cover,
the peripheral wall portion surrounds an outer diameter of the first stator, and
the first cover seals a first end portion of the peripheral wall portion.

2. The pump assembly according to claim 1,
wherein the first pump rotor is coaxially fixed to the motor shaft.

3. The pump assembly according to claim 1,
wherein the first pump has an inlet port and an outlet port,
wherein the inlet port and the outlet port are arranged in a first direction as viewed from the first pump rotor, and
wherein the first direction is a direction along an axis of the motor shaft and is a direction away from the motor rotor.

4. The pump assembly according to claim 1,
wherein the first pump is an internal gear pump including an external gear and an internal gear, and
wherein the external gear is the first pump rotor.

5. The pump assembly according to claim 4,
wherein the motor housing is configured to house the first stator and the motor rotor,
wherein the internal gear pump includes a pump housing configured to house the external gear and the internal gear,
wherein the motor housing includes a base portion to which the first yoke is fixed,
wherein the pump housing includes:
a body including a cylindrical portion, a bottom portion, and an annular flange portion, the cylindrical portion being configured to cover an outer periphery of the internal gear, the bottom portion being configured to seal a first end surface of the cylindrical portion, and the annular flange portion extending toward an outside of the cylindrical portion from an outer peripheral surface of the cylindrical portion at a position near a second end surface of the cylindrical portion,
a pump cover configured to seal an opening of the cylindrical portion at the second end surface, and
a bolt configured to fix the pump cover to the annular flange portion, and
wherein the annular flange portion constitutes the base portion.

6. The pump assembly according to claim 1,
wherein the first pump is a vane pump, and
wherein the first pump rotor includes a plurality of vanes.

7. The pump assembly according to claim 1, further comprising:
a second pump including a second pump rotor configured to be rotated by the motor rotor,
wherein the axial gap motor further includes a second stator disposed such that the motor rotor is interposed between the first stator and the second stator,
wherein the second stator includes a second yoke having an annular shape and a plurality of second teeth disposed on a second surface of the second yoke, and
wherein the second pump is disposed in a second internal space surrounded by the plurality of second teeth.

8. The pump assembly according to claim 1, further comprising:
a pump housing accommodating the first pump rotor,
wherein the pump housing includes a peripheral wall portion, a first cover which seals a first end portion of the peripheral wall portion, and a second cover which seals a second end portion of the peripheral wall portion, and
wherein the motor shaft penetrates the second cover.

9. The pump assembly according to claim 8,
wherein the second cover includes at least one recess formed on an inner surface facing the first pump rotor.

10. The pump assembly according to claim 9,
wherein the at least one recess includes two recesses provided at positions facing each other across the motor shaft.

* * * * *